United States Patent [19]

Kartfilt

[11] Patent Number: 4,852,323

[45] Date of Patent: Aug. 1, 1989

[54] NONPENETRATING ROOF MEMBRANE FASTENING SYSTEM

[75] Inventor: Henry A. Kartfilt, Noblesville, Ind.

[73] Assignee: The Firestone Tire & Rubber Company, Akron, Ohio

[21] Appl. No.: 200,280

[22] Filed: May 31, 1988

[51] Int. Cl.[4] ..... E04B 7/00; E04B 5/00

[52] U.S. Cl. ..... 52/410; 52/746

[58] Field of Search ..... 52/410, 512, 506, 746; 24/304, DIG. 11

[56] References Cited

U.S. PATENT DOCUMENTS

| | | | |
|---|---|---|---|
| 3,671,371 | 6/1972 | Wolf | 161/43 |
| 4,126,721 | 11/1978 | Vitt | 428/339 |
| 4,161,854 | 7/1979 | Stelzer | 52/309 |
| 4,162,597 | 7/1979 | Kelly | 52/410 |
| 4,272,573 | 6/1981 | Ewald | 428/40 |
| 4,330,581 | 5/1982 | Borgert | 428/64 |
| 4,389,826 | 6/1983 | Kelly | 52/410 |
| 4,437,283 | 3/1984 | Benoit | 52/410 |
| 4,441,295 | 4/1984 | Kelly | 52/408 |
| 4,467,581 | 8/1984 | Francovitch | 52/410 |
| 4,651,490 | 3/1987 | Marston | 52/410 |
| 4,688,361 | 8/1987 | Kelley | 52/173 |
| 4,712,348 | 12/1987 | Triplett et al. | 52/512 |

OTHER PUBLICATIONS

Barra Corporation of America, Inc. (Rhenofol PVC Membrane Roofing System) entire publication.

International EPDM Rubber Roofing Systems, Inc. (Diamond 105 Non-Penetrating System)-entire publication.

Benoit Inc. (Benoit E.P.D.M. Roofing Systems)-entire publication.

Kelley Energy Systems (Whaleskin/81 Rubber Roofing EPDM "Crackless Rubber"-entire publ.

Kelly Energy Systems, Inc. (Spec-Data Sheet)-entire publication.

Braas & Co. GmbH (Rhenofol CV-The plasticized PVC roofing membrane with synthetic, fibre reinforcement) entire publication.

Barra Corporation of America, Inc. (Braas Rhenofol PVC membrane Roofing Systems)-entire publication.

Specifications for Plate Bonded System-Author unknown.

Syenergy Methods, Inc. (The Syenergy Plate Bonded Roofing System . . . ) entire publication.

*Primary Examiner*—James L. Ridgill, Jr.

*Attorney, Agent, or Firm*—Ronald Brietkrenz

[57] ABSTRACT

A nonpenetrating roof membrane fastening system for covering and securing a waterproof flexible membrane on a roof deck. A plurality of flexible spot bonding pads are secured at spaced intervals to the roof by a smaller, more rigid, fastener plate or washer and a linear fastener which extends through the aligned centers of the pads and plates. An outer exposed peripheral area of each of the bonding pads has an adhesive applied thereto and bonds the pads to the underside surface of the flexible membrane which is laid over the secured pads avoiding any penetration of the membrane by the linear fastener. The membrane is a nonreinforced EPDM and the bonding pads are formed of a fabric reinforced EPDM. The pads have sufficient flexibility so that the pads bend and flex with the membrane as the membrane billows up under uplift wind forces but have an elongation factor considerably less than that of the unreinforced EPDM membrane so that the adhesive between the pads and membrane is placed in sheer enabling greater delamination forces to be exerted thereon than if placed in peel which occurs if a rigid bonding plate is used. The fabric reinforcement of the pads also prevents the pads from tearing away from the fastener or fastener plate.

12 Claims, 2 Drawing Sheets

PRIOR ART

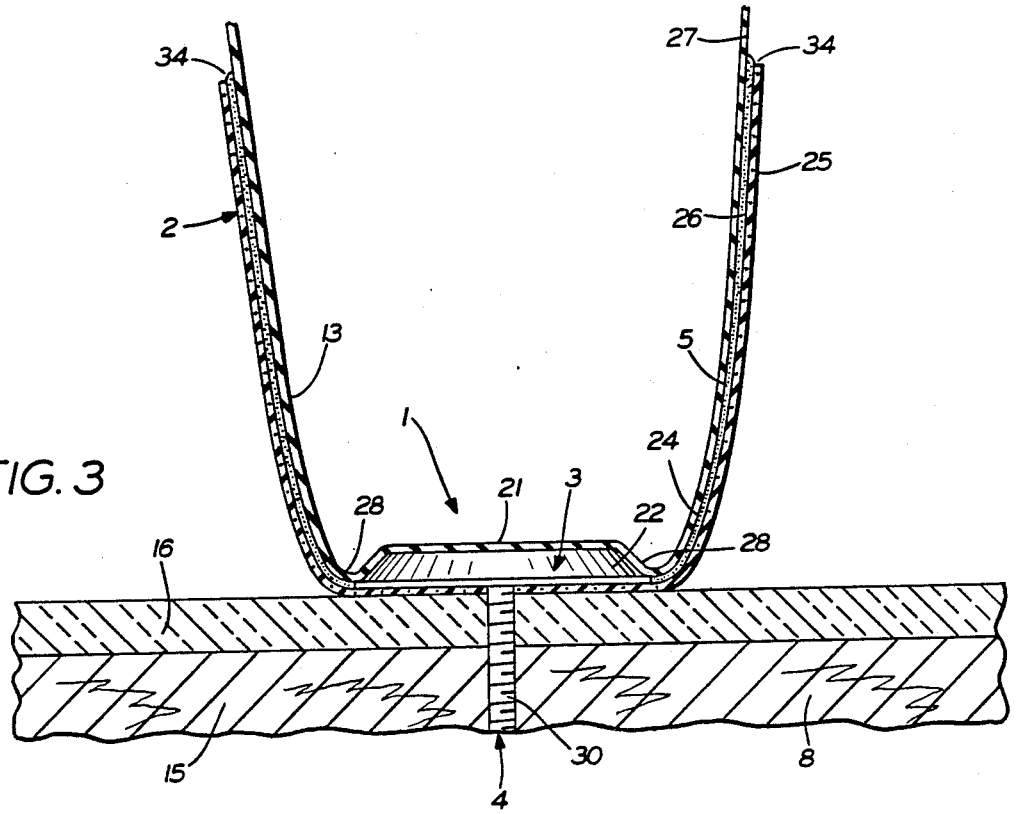
FIG. 3
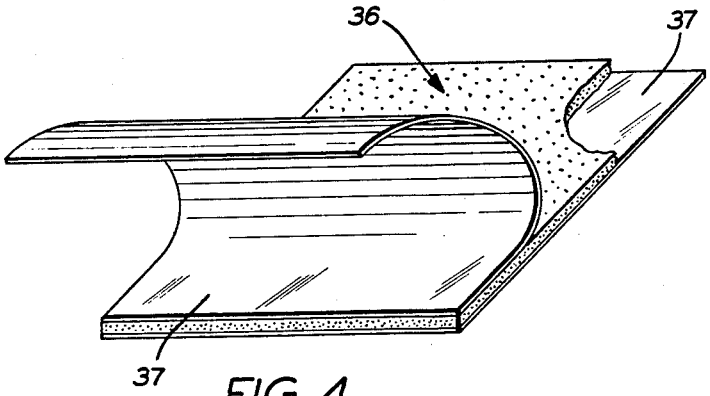
FIG. 4
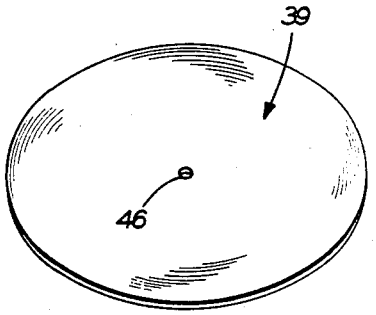
FIG. 5
FIG. 7 PRIOR ART
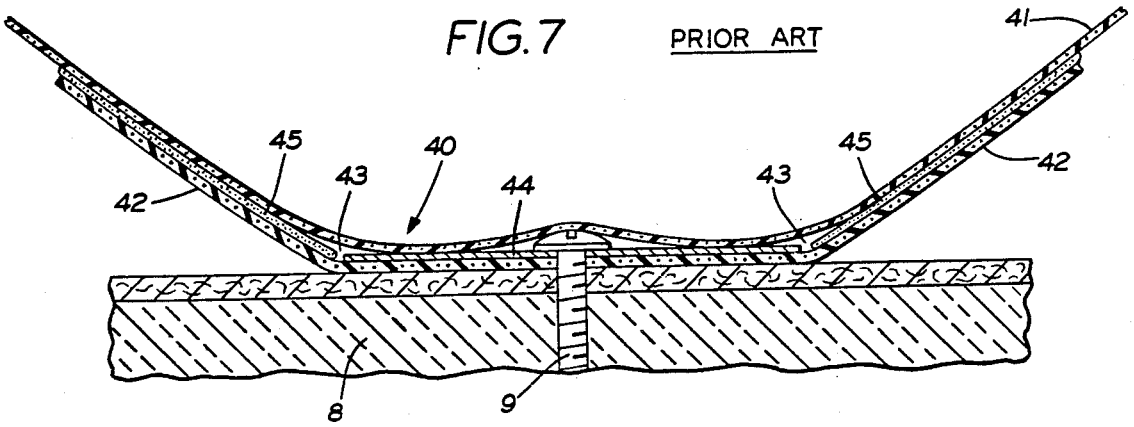

NONPENETRATING ROOF MEMBRANE FASTENING SYSTEM

FIELD OF THE INVENTION

The field of art to which this invention pertains is that of nonpenetrating fastening systems for securing a flexible sheet or membrane to a roof. More particularly, the invention relates to such a fastening system in which the membrane overlies and is secured to a flexible bonding pad by an adhesive.

DESCRIPTION OF THE RELATED ART

A large number of commercial and factory plant roofs are of a flat roof design wherein the roofing material itself is often of a built-up asphalt, and in more modern systems of a single ply of elastomeric sheet material or membrane which utilizes a mechanical ballast system or layer of stone over the membrane. While the ballast system is generally less expensive than a system using mechanical fasteners, it has a disadvantage of being quite heavy (approximately ten pounds per square foot) thus requiring a heavy roof support structure and, in addition, the roof slope cannot exceed ten percent.

Adhered roof membrane retention systems suffer from the cost penalty, while mechanical fastening systems generally require fixation of a component to the roofing substrate via mechanical fasteners. There are two basic kinds of mechanical fastening systems, namely, membrane penetrating and nonpenetrating types. Each of these types of systems has a number of favorable features and each of them is subject to various drawbacks and disadvantages.

Mechanical fastening systems of the penetrating type generally require fixation of one or more components thereof to the roofing substrate by a metal or rubberized nailing strip or plate. U.S. Pat. Nos. 4,445,306; 4,074,501; 4,455,804; 4,467,518; 4,620,402 and 4,630,422 are some examples of penetrating type fastening systems in which rigid and semirigid members are used to secure the membrane to the roof. These systems require openings to be formed in the membrane, either for receiving a fastening plate or by the attaching anchoring members.

Some examples of nonpenetrating type fastening systems are shown in U.S. Pat. Nos. 3,426,412; 4,519,175; 4,619,094; 4,651,490 and 4,617,771.

Although both the penetrating and nonpenetrating mechanical-type fastening systems do work satisfactory for many applications, it is desirable for certain applications to have a nonpenetrating system to eliminate piercing the membrane. Also, such a nonpenetrating fastening system can be installed in a minimum amount of time and without requiring skilled labor.

Another type of fastening system gaining in popularity is a nonpenetrating system in which the membrane is bonded to a bonding plate or pad which is secured to the roof surface beneath the membrane and is secured to the undersurface of the membrane by a bonding adhesive or fused thereto by a chemical solvent, or by sonic welding.

These plate bonded pad systems usually utilize a relatively large plate formed of a rigid material which is secured to the roof by a single attachment fastener, such as a nail or screw. The fastener may extend through a smaller washer placed on the bonding plate leaving an exposed peripheral area which is coated with an adhesive and secured to the undersurface of the overlying membrane which is formed either of a nonreinforced EPDM rubber or many other types of reinforced membrane, including PVC. In the roofing system which uses a reinforced PVC membrane, the membrane is bonded to the rigid plate by a solvent which effectively chemically welds the plasticized PVC to the rigid bonding plate.

However, it has been found that problems occur with such adhesively bonded or fused roofing systems using a rigid bonding plate in that the elastomeric membrane or sheet will subject the bonding adhesive to a "peel" action or force when the membrane is subjected to high uplift wind forces. The wind force will attempt to peel the membrane away from the rigid bonding plate occasionally resulting in premature separation therebetween preventing the roofing system from sustaining the required wind forces and causing the system to fail.

In another known bonded roofing system the membrane of reinforced PVC is chemically bonded to a flexible bonding pad also formed of reinforced PVC. This construction effectively eliminates the peeling problem since the two PVC materials are effectively welded together with the junction being as strong as the material itself. However, the PVC membrane is considerably more expensive than the EPDM membrane resulting in an expensive roofing system.

In still another known bonded roofing system, a membrane of unreinforced EPDM is bonded by an adhesive to a bonding pad also formed of unreinforced EPDM. Although this provides a less expensive roofing system than the PVC membrane and PVC bonding pad system, problems occur since the unreinforced EPDM pads tear relatively easily about their hold-down metal washers upon experiencing uplift wind forces. In addition, these pads can have a back peel problem caused by the extensive elongation of the non-reinforced pad. All the uplift force in the area of the plate is held by the small area of the unreinforced plate around its hold-down washer. This elongation causes the adhesive bond to fail.

The following patents disclose additional prior art pertaining to roof bonding systems and components or features thereof.

U.S. Pat. No. 4,161,854 discloses a roofing system in which the roof material may be secured to a plurality of disks attached to an insulating deck, by gluing, solution welding or high frequency welding. The disks are provided with a device to prevent the attachment screw thereof from disengaging prematurely from the roof.

U.S. Pat. No. 4,437,283 discloses a single ply roofing system for attaching a flexible roof sheet to the roof of a building. A sealing member includes a double-face tape and a cover member which is formed from an EPDM membrane. The tape fastens the membrane to the roof sheet which, in turn, is attached to the insulation.

U.S. Pat. No. 4,162,597 discloses a roof mounting system in which a rigid plate, such as masonite or plywood, is attached to the roof deck and a layer of adhesive is applied to the exposed surface of the plate and the rubber or plastic sheet is placed over the plate and is adhered thereto by the adhesive.

U.S. Pat. No. 4,467,581 discloses a roof anchoring system which uses a relatively thin resilient disc-shaped metal plate which is attached to the roof to clamp the membrane in position. The disc then is covered by a mastic and waterproof sheet of material. The disc of this patent is mounted on the top surface of the membrane and the fastener penetrates the membrane located beneath the disc.

U.S. Pat. No. 4,389,826 discloses another penetrating type of roof installation which uses a bonding plate formed of masonite or similar rigid material which is attached to a roof structure by a plurality of screws which also penetrate the waterproof membrane. An adhesive then secures a protective sheet over the penetrated membrane and associated clamping disc.

U.S. Pat. No. 4,441,295 discloses a roofing insulation in which the flexible membrane is adhered to a mounting board secured to the insulation block of the roof deck. The membrane is adhered to the board in marginal areas without any adherence to its central area. However, a complete covering board is required for bonding of the membrane thereto.

U.S. Pat. No. 3,671,371 discloses a device for attaching a thermoplastic foil to the top of a roof by heat sealing or welding the foil to a holding plate formed with a metallic core and a thermoplastic cover layer.

U.S. Pat. No. 4,688,316 discloses plate bonded roofing system in which the bonding plate includes a preapplied gum tape adhesive which covers the plate which is formed of masonite or other rigid material. The rigid plates are secured at selected positions along the roof and the covering membrane is secured by the adhesive to the fastened plates.

U.S. Pat. No. 4,330,581 discloses a sealing element made of a water resistant elastomer or polymer in a lamellifom structure of substantially circular shape having four to six waves radially thereabout used for sealing the covering to the outer corners of flat roofs.

Although many of these prior art roof covering systems and, in particular, plate bonding systems therefor, are satisfactory for certain operations, it is desirable to have a nonpenetrating system for certain applications to eliminate piercing the membrane. Also it is desirable that the membrane is formed of a less expensive EPDM elastomeric sheet in contrast to the more expensive reinforced PVC sheet, and that the membrane can be secured by flexible bonding pads which are easily installed on the roof, to enable the attached membrane to withstand greater wind forces without separation from the bonding pads than prior art rigid bonding plates and systems, and prior art flexible bonding pads of reinforced PVC or unreinforced EPDM.

SUMMARY OF THE INVENTION

Objectives of the invention include providing an improved roof membrane fastening system for securing a waterproofing membrane to a roof deck without any opening or puncture being imparted into the membrane thereby lessening the number of openings in the membrane during installation and subsequent possible areas of leakage.

A further objective is to provide such an improved fastening system in which a plurality of bonding pads are placed in various arrangements over the roof surface to provide the required holding power for the membrane; and in which the bonding pads can be installed in a minimum amount of time and in an extremely efficient manner while reducing the possibility of the pads being installed incorrectly.

Still another objective of the invention is to provide such an improved fastening system in which the bonding pads, are formed of a reinforced EPDM, and are attached to the roof at selected locations by a single fastener and a rigid fastening washer having a considerably smaller size diameter than that of the bonding pad; and in which an exposed outer peripheral area is provided between the washer and edge of the bonding pad for receiving an adhesive for subsequently bonding the overlying flexible membrane to the bonding pad.

Another objective is to provide such an improved roof fastening system in which the bonding pad has sufficient flexibility generally equal to that of the covering membrane whereby the bonding pad can curve and flex upwardly with the upward movement or billowing action of the secured membrane; in which the bonding pad is formed of a reinforced flexible material sufficient to resist tearing away from the overlying attachment rigid washer and which has a relatively low elongation factor in comparison to that of the unreinforced EPDM membrane, thereby placing the connecting adhesive between the membrane and bonding pad in shear in contrast to the peel forces which are exerted on the adhesive when bonding the flexible membrane to a rigid base plate; and in which this reinforced flexible, low elongation bonding pad enables the secured membrane which is formed of the relatively inexpensive nonreinforced EPDM material to withstand higher uplift wind forces since the adhesive is able to withstand larger forces in shear loading than in the peel loading as occurs with a rigid bonding plate.

A still further objective of the invention is to provide such an improved roof fastening system in which the attachment washer is formed with a recessed central area for receiving a pool of sealant to provide a cushioning seal about the head of the linear fastener which extends through the central opening of a fastening washer to prevent possible damage to the covering membrane and to prevent possible backout of the fastener from its installed position. The raised annular ring also provides slack in the membrane thereby preventing peel at the washer.

A further objective of the invention is to provide such an improved fastening system in which the bonding pads are formed of EPDM, reinforced with a fabric such as polyester, and which is used in conjunction with a nonreinforced EPDM roofing membrane which is less expensive than the reinforced PVC membrane.

Another objective of the invention is to provide such an improved fastening system in which the bonding pad may be attached to the membrane by a contact adhesive or by a pressure sensitive adhesive tape; in which the bonding pad may have various configurations such as circular or rectangular and is considerably greater in overall area than the area of the rigid fastening washer; and in which the bonding pad in conjunction with the attachment washer and fastener provide an extremely inexpensive and effective fastening system for achieving the objections of the invention in a simple, economical and efficient manner.

Still another objective of the invention is to provide such an improved fastening system which has a lower profile on the roof than most other types of mechanical fastening systems, which is less susceptible to damage from the top of the membrane such as that caused by individuals walking on the roof or objects being dropped on the membrane fastener and bonding pad; and in which the rubber-to-rubber adhesive bond between the EPDM membrane and bonding pad is a proven method of attachment.

These objectives and advantages are obtained by the improved nonpenetrating roof membrane fastening system of the invention, the general nature of which may be stated as including a plurality of flexible spot bonding pads arranged in a spaced relationship on a roof deck, said pads having upper and lower surfaces and formed of reinforced EPDM; a fastener plate mounted on the upper surface of each of the bonding pads and having a smaller area than that of the bonding pad to provide a peripheral exposed area on each of the bonding pads surrounding said fastener plates, said fastener plates having a greater rigidity than the flexible bonding pads; fastener means extending through each of the bonding pads and fastener plates for securing said pads and plates to the deck; a flexible waterproof membrane formed of nonreinforced EPDM supported by the deck and covering the secured bonding pads and fastener plates; an adhesive bonding an underside surface of the membrane to the exposed peripheral areas of the bonding pads to secure said membrane to the pads; and said bonding pads having sufficient flexibility so that the bonded peripheral areas thereof flex with the upward movement of the bonded membrane upon said membrane experiencing uplift wind forces and having an elongation factor at most one tenth that of the nonreinforced membrane so that the adhesive is subject to a shear separation force and is relatively free of peel forces.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

FIG. 3 is an enlarged sectional view similar to FIG. 2 showing the effect of uplift wind forces on the improved fastening system which places the bonding adhesive in shear in contrast to the peel forces exerted on a prior art roof bonding system using a rigid bonding plate as shown in FIG. 6;

FIG. 4 is a perspective view with portions broken away, showing a pressure sensitive adhesive and associated backing substrates which may be used with the improved fastening system of the invention as shown in FIGS. 1–3;

FIG. 5 is a reduced perspective view of a disc-shaped bonding pad in contrast to the rectangular-shaped bonding pad as shown in FIGS. 1–3;

FIG. 7 is another diagrammatic sectional view similar to FIG. 6 showing another prior art roof bonding system which uses a PVC membrane and PVC bonding pad.

Similar numerals refer to similar parts throughout the drawings.

BEST MODE FOR CARRYING OUT THE INVENTION

Figure 1:
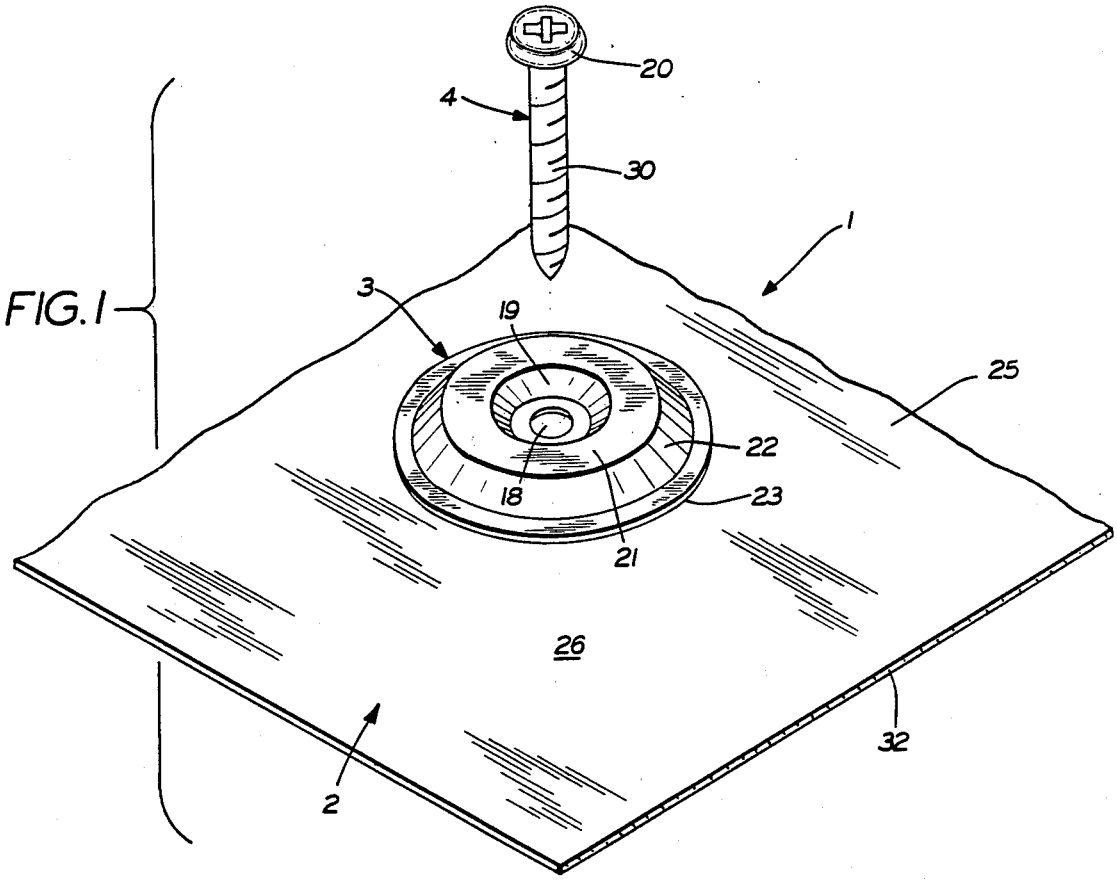
FIG. 1 is an enlarged fragmentary perspective view showing some of the main components of the improved nonpenetrating roof fastening system of the invention.
Figure 2:
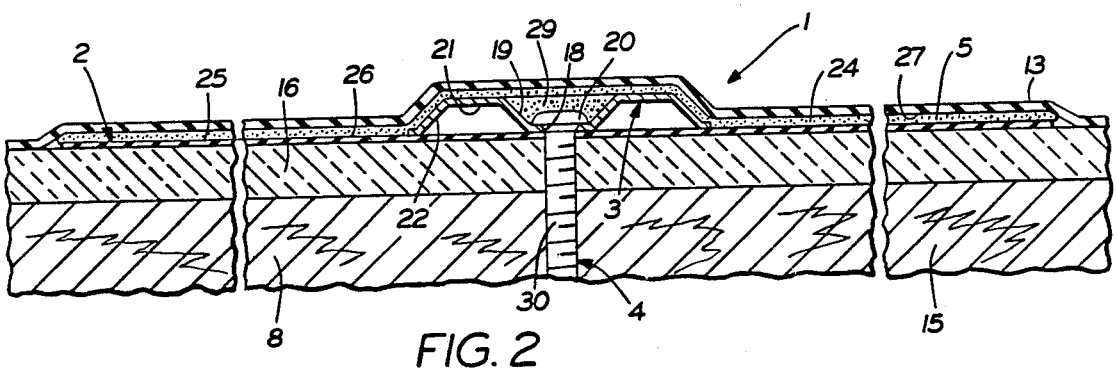
FIG. 2 is a fragmentary sectional view showing the fastening system in an installed position on a roof.

The improved fastening system of the invention is indicated generally at 1, and is shown particularly in FIGS. 1–3. Fastening system 1 includes as its principle components a bonding pad, an attachment washer or plate, and a fastener, indicated generally at 2, 3 and 4, respectively, (FIG. 1). Another important component of the improved fastening system is an adhesive 5 and the covering membrane 13, shown particularly in FIGS. 2 and 3.

Figure 6:
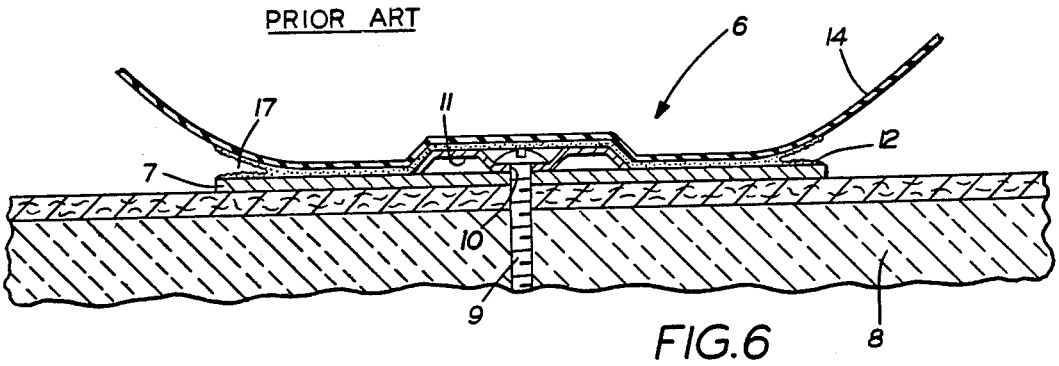
FIG. 6 is a diagrammatic sectional view showing a prior art roof bonding system using a rigid bonding plate and associated membrane in which the bonding adhesive is subjected to shear during uplift wind forces on the covering membrane.

In order to fully understand the features and advantages of the fastening system of the present invention, two of the closest known prior art fastening systems are shown in FIGS. 6 and 7, and are described below.

One example of such a prior art fastening system of which the present invention is an improvement thereon, is indicated generally at 6 and is shown in FIG. 6. Fastening system 6 includes a rigid bonding plate 7, formed of metal, plastic, masonite, etc. which is secured to a roof 8 by a single attachment screw 9, which extends through a central opening 10 of an attachment washer 11. An adhesive 12 bonds a membrane 14 to plate 7. Membrane 14 may be formed of a nonreinforced EPDM rubber material or a more expensive reinforced PVC thermoplastic material, both of which are roof membranes well known in the art. However, as shown in FIG. 6, the rigidity of bonding plate 7 will place adhesive 12 in a "peel" condition upon the membrane experiencing uplift wind forces which billows the membrane upwardly as shown therein. It is well known that adhesives are able to withstand considerably more sheer force than a peel force. Therefore, the adhesive of FIG. 6 will fail at relatively low uplift forces resulting in premature failure of the roofing system as shown at 17.

In another prior art roof fastening system shown in FIG. 7 and indicated at 40, a reinforced PVC membrane 41 is chemically bonded to a flexible bonding pad 42 which is formed of the same reinforced PVC thermoplastic material as is membrane 41. The membrane and flexible pad are fused or welded together by use of a chemical adhesive 45 or other type of chemical solvent and is able to withstand larger uplift wind forces than the bonding system as shown in FIG. 6 which uses the rigid bonding plate. The system of FIG. 7, however, may begin to experience peel forces in the areas indicated at 43, and since the reinforced PVC billows or raises from the roof very little, the wind loads tend to pull the assembly apart. The single major disadvantage of a roof bonding system such as shown in FIG. 7, is the cost of the PVC membrane and PVC pads in contrast to the less expensive nonreinforced EPDM membrane of the system showing in FIG. 6 and that of the present invention.

Improved fastening system 1 is shown in FIGS. 2 and 3 installed on a roof 8 of the type which consists of a roof deck 15 covered by an insulation sheet 16. A plurality of bonding pads 2 are placed at spaced intervals on the top surface of the roof and are secured thereto by attachment screws 4 extending through a central opening 18 formed in attachment washer 3. Washer 3 preferably has a recessed central area 19 in which the head 20 of screw 4 is located, and has a raised annular central portion 21 and a conical-shaped outer portion 22 terminating in an annular end flange 23. However, this configuration of attachment washer 3 can vary somewhat without materially affecting the concept of the invention.

After securing bonding pads 2 at the desired locations by screws 4 and washers 3, a layer of adhesive 24 is applied to an exposed area 25 of the top surface 26 of each bonding pad 2 which surrounds attachment washer 3 as shown in FIG. 2. This adhesive bonds the pads to the adjacent underside surface areas 27 of membrane 13 in overlying contact therewith after the membrane has been spread over the attached bonding pads.

Preferably, prior to the laying of the membrane over the attached pads, an adhesive sealant 29 is placed in recess 19 of washer 2 covering fastener head 20 to provide a cushion between the membrane and fastener head and to prevent backout of the fastener from its installed position.

In accordance with the invention, bonding pad 2 is formed of a flexible, fabric reinforced EPDM polymer or rubber. Pad 2 preferably is reinforced with a polyester fabric indicated at 32. One type of fabric reinforcement which has been found to be satisfactory has a square weave within the range of 9×9 to 16×16 of a high tenacity material having a denier weight within the range of 800 to 1000. One type of EPDM material found suitable for membrane 13 which preferably is the same material from which pads 2 are formed, has a specific gravity of 1.15±0.05, with a minimum tensile strength of 1305 psi, a tear resistance of 150 lbs./in., and a Shore A durometer of 65±10. The nonreinforced membrane will have a minimum elongation of 300%. Most importantly pad 2 has an elongation factor of at most one tenth that of membrane 13.

In the particular embodiment shown in FIGS. 1–3, bonding pad 2 has a rectangular or square configuration with the preferred size being 10 inches. Attachment washer 3 is considerably smaller than pad 2, and in the preferred embodiment, has a diameter of two inches. This relationship enables the bonding pad to flex outwardly about washer 3 as shown in FIG. 3 when membrane 13 experiences high uplift wind forces, and provides a sufficiently large exposed area 25 for bonding the membrane thereto. The formation of bonding pad 2 of a reinforced flexible EPDM material provides a highly flexible pad with a very low elongation factor. This flexibility enables the pad to flex or bow with the movement of membrane 13 as shown in FIG. 3 eliminating nearly all peel forces exerted on the adhesive, and subject the adhesive to "shear" as indicated at 34. It is well known in the art that adhesives are able to withstand considerably larger shear forces before separation of the parts joined thereby than if subjected to peel forces as shown in FIG. 6.

Also since the membrane is not bonded to conical-shaped outer portion 22 of plate 3 as shown in FIG. 3, a slack loop 28 is created in this area. This slack loop eliminates a peel force from being created in this area in contrast to the prior art system as shown in FIG. 7 at 43.

Also the low elongation factor of the flexible pads in comparison to that of the attached membrane, prevents the pad from stretching with the membrane. It is this relationship which places the adhesive in sheer and eliminates the pad from tearing away from the fastener or washer as occurs when a pad formed of a nonreinforced EPDM membrane is used as in the prior art.

In one particular test to indicate the results of peel versus shear forces exerted by wind uplift forces on bonding adhesives, a test was performed on a 5×9 foot wind uplift table, of the type used for evaluating roofing system capabilities. The results of a fastening Assembly No. 1 such as fastening system 1 of the invention (FIGS. 2 and 3), was compared with that of a fastening Assembly No. 2, such as fastening system 6 as shown in FIG. 6, which uses a rigid bonding plate, for various wind forces. Assembly No. 1 consisted of a 12 inch square flexible reinforced EPDM bonding pad and a two inch rigid attachment washer. Assembly No. 2 consisted of a 12 inch rectangular rigid plate.

The test indicated that Assembly No. 2 failed with an uplift wind force of approximately 60 psf in which membrane delamination occurred. Whereas the reinforced flexible, low elongation pad of Assembly No. 1 failed at an uplift wind force of approximately 105 psf, caused by the fastener pulling through the attachment washer with very minor membrane delamination having occurred. It was determined that the adhesion between the membrane and bonding pad for both Assemblies was tested at 7 lbs./in. peel and 25 lbs./in. shear. Thus, the test results of the improved fastening system indicated that the adhesive is no longer the weak link in such an adhesive bonding system since the adhesive is placed in shear in contrast to being placed in peel as in prior art roof bonding systems using a EPDM membrane with a rigid bonding plate.

Membrane 13 has an elongation factor of between 300% and 400% but normally will experience a maximum elongation of up to 100% in most roof covering applications. Pad 2 will have a failure elongation of approximately 15% but will only experience an elongation of between 2%–3% during normal wind force loading and a maximum elongation of approximately 5% under maximum loading. Although the elongation characteristics for the membrane and pad may vary, the relative relationship therebetween is very important, namely, that the membrane will have an elongation at least ten times greater than that of the pad, with the usual elongation being generally twenty times that of the pad.

FIG. 4 shows a modified form of an adhesive which may be used with the improved roof fastening system. The adhesive is a pressure sensitive adhesive indicated generally at 36, and is covered by protective sheets of a release paper 37 whereby the adhesive can be applied from rolls instead of using an adhesive which is applied with a brush, spray or in a more liquid form to exposed areas 25 of the bonding pads as described above.

A modified bonding pad, indicated generally at 39, is shown in FIG. 5 and has a circular or disc-shaped configuration in contrast to the rectangular or square configuration of bonding pad 2 described above. Also, if desired, a preformed hole 46 may be formed in pad 39 as well as in pad 2, through which the attachment screw 4 extends when securing pads 2 and 39 onto roof 8. Such a preformed hole insures that the center of the pad is aligned with the center of the holddown washer and increases installation accuracy.

It has been found that a pad thickness of approximately 0.045 to 0.060 inches, when formed of the particular fabric reinforced EPDM material discussed above, has proven to be satisfactory. Also a bonding pad having an outer diameter or cross-sectional configuration which is approximately five times that of the corresponding attachment washer has been found to be satisfactory. For example, disc-shaped bonding pad 39 (FIG. 6) will have a diameter of ten inches in contrast to the two inch diameter of attachment washer 3. This relationship has been found to provide the desired amount of exposed area 25 surrounding the attachment washer to provide sufficient flexing and bowing of this area with the billowing movement of membrane 13 as shown in FIG. 3, to insure that the adhesive is subjected mainly to shear forces and not to peel forces.

The improved roof membrane fastening system is suitable for flat roofs as well as spherical and other configured roofs, and achieves the leakproof advantage of prior nonpenetrating fastening systems, and is able to withstand considerably greater uplifting wind forces which are exerted on the membrane prior to failure in contrast to prior art fastening systems using a rigid bonded roof plate which subjects the securing adhesive to shear forces, and is less expensive than roof bonding systems using a reinforced PVC membrane.

In summary the improved fastening system enables a less expensive EPDM membrane to be used instead of the more expensive PVC membrane by using adhesive bonding pads formed of reinforced EPDM, wherein the flexibility of the pad approaches that of the membrane but has an elongation factor at most one tenth that of the membrane.

Accordingly, the improved fastening system is simplified, provides an effective, safe, inexpensive, and efficient system which achieves all the enumerated objectives, provides for eliminating difficulties encountered with prior systems, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved nonpenetrating roof membrane fastening system is constructed and used, the characteristics of the system, and the advantageous, new and useful results obtained; the new and useful structures, devices, elements, arrangements, parts, and combinations, are set forth in the appended claims.

What is claimed is:

1. In a roofing structure of the type having a deck for supporting the roofing structure, said structure including:

(a) a plurality of flexible bonding pads arranged in a spaced relationship on the deck, said pads having upper and lower surfaces and formed of reinforced EPDM;

(b) a fastener plate mounted on the upper surface of each of the bonding pads having a raised substantially annular portion, and having a smaller area than that of the bonding pads to provide peripheral exposed areas on each of the bonding pads surrounding said fastener plates, said fastener plates having greater rigidity than the flexible bonding pads;

(c) fastener means extending through each of the bonding pads and fastener pates for securing said pads and plates to the deck;

(d) a flexible waterproof membrane formed of nonreinforced EPDM supported by the deck and covering the secured bonding pads and fastener plates;

(e) an adhesive bonding an underside surface of the membrane to the exposed peripheral areas of the bonding pads to secure said membrane to the pads with said membrane being relatively slack along the raised annular portion of the fastener plates; and (f) said bonding pads having sufficient flexibility so that the bonded peripheral areas thereof flex with the upward movement of the bonded membrane upon said membrane experiencing uplift wind forces, and having an elongation factor at most one tenth that of the nonreinforced membrane so that the adhesive is subject to a shear separation force and is relatively free of peel forces.

2. The roofing system defined in claim 1 in which the bonding pads are reinforced with polyester fabric.

3. The roofing system defined in claim 1 in which the membrane has a minimum elongation factor of 300%; and in which the maximum elongation factor of the bonding pads is 15%.

4. The roofing system defined in claim 1 in which the reinforcing fabric of the bonding pads is polyester, having a square weave in the range of $9\times9$ to $16\times16$, and has a denier in the range of 800 to 1000.

5. The roofing system defined in claim 1 in which the bonding pads have a thickness within the range of from 0.045 to 0.060 inches.

6. The roofing system defined in claim 1 in which the fastener means is a linear fastener; in which the fastener plate is a metal disc-shaped washer having a recessed central area with a hole formed therein through which the fastener extends; and in which a sealant material is placed in the recessed central area and covers an exposed head of said fastener.

7. The roofing system defined in claim 1 in which the bonding pads are rectangularly shaped and the fastener plates are disc-shaped.

8. The roofing system defined in claim 1 in which the bonding pads are approximately ten inches square and the fastener plates have a diameter of approximately two inches.

9. The roofing system defined in claim 1 in which the bonding pads and fastener plates are disc-shaped; and in which the diameter of each of the bonding pads is approximately five times the diameter of the fastener plates.

10. The roofing system defined in claim 1 in which the bonding pads experience an elongation of approximately 5% under maximum wind loading conditions.

11. The roofing system defined in claim 1 in which the membrane has a tensile strength of at least 1305 psi.

12. The roofing system defined in claim 10 in which the bonding pad has a Shore A Durometer of $65\pm10$.

* * * * *

UNITED STATES PATENT AND TRADEMARK OFFICE

CERTIFICATE OF CORRECTION

PATENT NO. : 4,852,323

DATED : August 1, 1989

INVENTOR(S) : Henry A. Karrfalt

It is certified that error appears in the above-identified patent and that said Letters Patent is hereby corrected as shown below:

On the title page, under item [19], "Kartfilt" should read --Karrfalt-- and item [75] Inventor: "Henry A. Kartfilt" should be --Henry A. Karrfalt--

Signed and Sealed this

Twenty-ninth Day of May, 1990

*Attest:*

HARRY F. MANBECK, JR.

*Attesting Officer*

*Commissioner of Patents and Trademarks*